United States Patent [19]

Lake

[11] 4,427,336

[45] Jan. 24, 1984

[54] SINGLE VANE ROTODYNAMIC IMPELLER

[76] Inventor: Geoffrey G. Lake, 29 Wallingford Rd., Wallingford, Cholsey, Oxfordshire, England

[21] Appl. No.: 198,070

[22] PCT Filed: Nov. 16, 1979

[86] PCT No.: PCT/GB79/00195

§ 371 Date: Jun. 18, 1980

§ 102(e) Date: Jun. 18, 1980

[87] PCT Pub. No.: WO80/01095

PCT Pub. Date: May 29, 1980

[30] Foreign Application Priority Data

Nov. 17, 1978 [GB] United Kingdom ..... 45068/78

[51] Int. Cl.[3] ..... F04C 1/04; F04C 3/02

[52] U.S. Cl. ..... 415/71; 416/176

[58] Field of Search ..... 415/71, 72; 416/176 R; 418/212 A, 213 A, 213 C

[56] References Cited

U.S. PATENT DOCUMENTS

| | | | |
|---|---|---|---|
| 2,407,748 | 9/1946 | Schmidt | 415/72 |
| 3,035,781 | 5/1962 | Wallen | 416/176 |
| 3,156,190 | 11/1964 | Stahle | 415/72 |
| 3,644,056 | 2/1972 | Wiselius | 415/72 |

FOREIGN PATENT DOCUMENTS

| | | | |
|---|---|---|---|
| 2855385 | 11/1979 | Fed. Rep. of Germany | 415/71 |

*Primary Examiner*—Louis J. Casaregola

*Attorney, Agent, or Firm*—Oblon, Fisher, Spivak, McClelland & Maier

[57] ABSTRACT

A single vane impeller having particular application for pumping liquids having a high solids content is disclosed having an axial feed inlet configuration and a centrifugal outlet configuration giving an impeller capable of outlet modification by cutting to accommodate differing pumping requirements.

11 Claims, 4 Drawing Figures

SINGLE VANE ROTODYNAMIC IMPELLER

The present invention relates to a single vane rotodynamic impeller and to a pump utilising such an impeller for use more particularly but not exclusively for pumping liquids having a high solids content e.g. liquids containing industrial waste, sewage, fish, fruit and vegetables, and the like in which applications it is clearly important that suspended solid matter can pass freely through the pump.

The term "impeller" is used herein as the primary purpose of the invention is to provide improved means for handling liquids with a high solids content. It is however, contemplated that the impellers of the invention may find uses in other fields of materials handling e.g. as feeders or the like for particulate solids.

BACKGROUND ART

A variety of types of impellers have in the past been used for pumps for use in pumping liquids having a high entrained solids content, typical of these being twin vaned centrifugal pumps and vortex pumps. The former are somewhat prone to "ragging" i.e. to entrapment of the solid content on or within the impeller whereas the latter, while significantly less prone to ragging, operate inefficiently. Single vane impellers operating on a substantially axial feed are known as for example in U.S. Pat. No. 3,156,190 which describes a spiral screw blade encircling a surface of a flared hub or core portion, but while such impellers can be constructed to function to good effect and efficiency in pumping liquids having a high solids content without significant ragging, the performance of such impellers can in general not be adjusted without considerable difficulty and expense and even then rarely without operation of the pump set at reduced efficiency.

The technique of cutting a centrifugal impeller to modify its pumping performance, for example its pressure head generated at a given rotational velocity, is well known although for reasons largely concerned with impeller balance is primarily of interest in the modification of multivaned, inherently balanced impellers. The cutting of substantially axial impellers is rarely feasible or effective.

The prior art discloses a number of impellers for a variety of different purposes having spiral or helical type vanes encircling a flared hub or core portion, the impellers being for a variety of different purposes. For example U.K. Patent Specification No. 174184 discloses a multivaned substantially centrifugal impeller of the closed or shrouded type for water, U.S. Pat. No. 3,035,781 discloses an impeller for a pulper for suspending dried pulp in water, U.S. Pat. No. 3,644,056 discloses a centrifugal pump having a vaned impeller for unspecified liquids and U.K. Patent Specification No. 1153993 discloses a rotary impeller pump having a high speed impeller intended as a super-cavitating pump for aircraft fuel systems. None of these specifications disclose, appreciate or suggest the problem facing the present applicants, namely to produce a single vane impeller for pumping liquids having a high entrained solids content, the impeller being adjustable by cutting to modify its pumping performance without detriment to its solids handling ability and without significant detriment to its pumping efficiency. The requirement for the impeller to be single vaned itself arises from the need for the impeller to be non-ragging, the use of a plurality of vanes of necessity introducing points of interception of surfaces or edges as locations where ragging can occur, and also restricts the size of solid that can effectively be pumped.

DISCLOSURE OF THE INVENTION

According to the present invention a rotodynamic impeller suitable for pumping liquids having entrained solids matter comprises a single spiral vane encircling a flared core, the vane twisting by reduction of its radius angle from a substantially axial inlet configuration to a substantially centrifugal outlet configuration, the inlet configuration comprising an inlet edge extending upstream and radially outwardly from the core at the axis, the inlet edge curving to increase its axial component as it approaches the core such that in operation in a pump solid matter impinging on the inlet edge will be swept inwardly along the edge and thence through the impeller to the outlet, the outlet configuration being such that the radius angle of the vane at the outlet is less than 30°, the subtended angle is less than 22½° and the vane has a positive outlet angle.

The single vane is preferably formed so that it makes a smooth transition between the inlet and outlet configurations, the impeller displaying the advantages of enhanced solids flow promotion due to the positive displacement characteristics of its inlet configuration combined with the enhanced energy output potential of its outlet configuration, the smooth transition between the two allowing for unhindered passage of solids material through the impeller, the impeller being capable of modification by cutting to suit varying pumping requirements.

The vane should be as thin in section as is commensurate with its required strength, to ensure maximum passage volume. However variation in basic vane thickness and vane shape (both in section) enables the vane to be, for example, cast approximately to a balanced configuration.

The flare of the core, i.e. the increase in its radius from its inlet to its outlet ends may itself generate a modicum of centrifugal performance. The centrifugal performance characteristics required of the impeller outlet according to the present invention are in excess of any centrifugal characteristic imparted by the said increase in core radius. The core itself may flare in a linear fashion or so as to produce a curved, e.g. inwardly curved or concave outer core surface.

The term "radius angle", hereafter referred to as $\beta$, is used herein to refer to that angle made with the rotational axis of the impeller on the inlet side by the line of a section of the vane on a plane through the axis of the impeller, this line for design and analytical purposes being the line joining the mean of the thickness of the outer edge of the vane and the mean of the thickness of the root of the vane where it joins the core surface. The vane itself may curve away from this line, for example with the vane inner surface being convex at the inlet changing gradually to slightly concave at the outlet, but this definition of radius angle nonetheless applies, the mean chordal line being used to define $\beta$.

The above definition of $\beta$ may be applicable with difficulty, if at all, to the part of the impeller adjacent the inlet edge. This does not affect the applicability of the definition to the vane shape elsewhere on the impeller.

The greater the twist i.e. the nearer $\beta$ gets to zero at the outlet edge, the greater the centrifugal characteristic of the impeller output. However, it may be that in some circumstances, such as for a higher specific impeller speed, that a practical minimum $\beta$ of about 20° becomes necessary to avoid problems such as a hydraulic imbalance resulting from an excessive difference in lengths of the inner and outer vane edges. A decrease in $\beta$ of from 30° to 70° from inlet to outlet, for example about 45° is preferred, the $\beta$ at the outlet of the vane being substantially normal to the flow or streamline at the outlet.

A disadvantage of too large a $\beta$ at the outlet can be that the vane will approach the core portion at too acute an angle thus forming a potential trap between the rear surface of the vane and the core surface for solids entrained in the liquid being pumped. This disadvantage is in addition to the difficulty in cutting which will be afforded by a large $\beta$ at the outlet.

The decreasing radius angle $\beta$ allows construction of a passage shape through the impeller which can pass solids of large size relative to the length of the pump or conversely construction of a shorter pump relative to the size of solid it may be required to handle.

The term "subtended angle" is used herein to refer to the angle subtended at the impeller axis, when viewed axially, by the outlet or trailing edge of the vane. The term "outlet or trailing edge" is used herein to refer to the edge of the vane at its outlet end which is substantially free of contact with the conical surface of the pump casing within which it is to operate. This edge continues from the radially outer edge of the vane but will normally be distinguishable therefrom by an arris or other discontinuity. The juncture of the radially outer vane edge and the outlet edge may nonetheless be radiused. The outlet or trailing edge may be substantially linear and the smaller the subtended angle the better for reasons which will become apparent below. The subtended angle is referred to hereafter as $\theta$.

The outlet angle of the vane, to be referred to as outlet angle $\phi$ is the angle made, in plan view by a section of the vane along a streamline with the surface of revolution generated by the outlet edge. The angle $\phi$ is preferably in the range of 5° to 15° and as the outlet edge may itself be non linear, the angle $\phi$ may vary across the width of the vane.

The term "streamline" is used to refer to the mathematically or empirically definable notional boundaries within fluid flow through the impeller across which there is no flow. Consequently the streamlines must be entirely in the direction of fluid motion. The term is accepted and understood in the art and these comments are by way of guidance.

The basic hydraulics of a vaned rotodynamic impeller are designed on a given vane length and diameter being efficient at a given rotational speed to achieve a certain pumping head. Impellers according to the present invention can be cut to vary vane length and effective diameter to bring about modification of their pumping performance, particularly pressure head at a given flow rate, without undue effect on their inlet characteristics and also without undue effect on their overall efficiency. This cutting is achieved by removal of material from the outlet edge which will reduce the tip speed of the edge (for a given rotation speed) which will reduce the energy imparted to the pumped fluid and consequently reduce the head produced by rotating the impeller within a pump. The cutting operation may be effected in accordance with normal machining practices and furthermore, due to the low angles $\beta$ and $\theta$ at the outlet, and the positive angle $\phi$, the distribution of the removed material is such that compensating for the inevitable change of balance which results can be effected easily by adjustment, e.g. of bob-weights located within the impeller core.

If the outlet angle $\phi$ is too shallow, or negative, modification of the impeller by cutting the outlet edge of the vane can result in excessive shortening of the vane length, thus increasing the possibility of cavitation and consequent pump damage.

The inlet tip of the impeller is radially spaced from the impeller axis upstream of the core. The leading or inlet edge, i.e. that edge of the impeller extending from the inlet tip to the upstream tip of the core, is preferably a concave forward facing curve, its outer streamline leading its inner streamline. The leading edge may curve such that a tangent to any point on the edge makes less than 45° with the streamline at that point.

These constraints of the form of the leading edge should be, or combined to be, such as to cause the flow of liquid through the impeller to sweep solids along the inlet edge towards the axis, thus reducing or preferably eliminating the peripheral components of fluid flow on said solids which might otherwise retain the solids on the vane. The leading edge should therefore be other than the radial in any plane normal to the axis.

The inlet edge is preferably chamfered or rounded and should make a smooth continuous curve with the core surface. Where the inlet edge/core junction is interrupted e.g. by means for attachment of the impeller to its drive, said means should be located entirely below the said smooth continuous curve. The vane in the region of the inlet edge is preferably of minimum bulk for ease of balance.

The inlet edge should extend from the core at the axis, the inlet edge preferably intersecting the impeller axis at, or slightly upstream of the core itself.

The inlet edge should therefore be such that in use the component of flow along its edge towards the impeller axis is at all times greater than the component of flow across the edge, the components across the edge being the above mentioned peripheral components of fluid flow. In a preferred form of invention the ratio of the radial displacement of the inlet tip from the axis to the axial length of the inlet edge is in the region of 0.5 to 0.75, such as 0.71.

The axial distance from the inlet tip to the intersection of the radially outer vane edge and the outlet edge may preferably be equal to or greater than the axial length of the outlet edge. This ratio is believed to offer advantages in the solids handling capacity of the impeller.

The impeller may be provided with a complimentary casing or shroud having an inner surface conforming substantially to the surface of rotation generated by the radially outer edge of the vane.

When the impeller is open, the casing is formed to allow a slight clearance for rotation of the impeller within it. The casing will be adapted for attachment to an appropriate pump housing. The said clearance may be uniform or may be flared, curved or tapered.

When the impeller is closed or "shrouded" the shroud is rigidly fixed to the said outer edge for rotation therewith i.e. there is no clearance.

According to a further aspect of the invention a pump comprises a single vane impeller as defined above, the impeller being rotatably mounted in a pump casing, and means for rotation of the impeller within the casing to pump liquid and entrained solid therethrough.

BRIEF DESCRIPTION OF THE DRAWINGS

The aspects of the invention may be brought into practice in various ways and an embodiment will now be described by way of example, with reference to the accompanying drawings, in which:

Referring to the drawings, FIG. 1 shows the spiral vane 11 of an impeller 10, the vane 11 being affixed along its radially inner edge 12 to a flared impeller core 13.

BEST MODE FOR CARRYING OUT THE INVENTION

Figure 1:
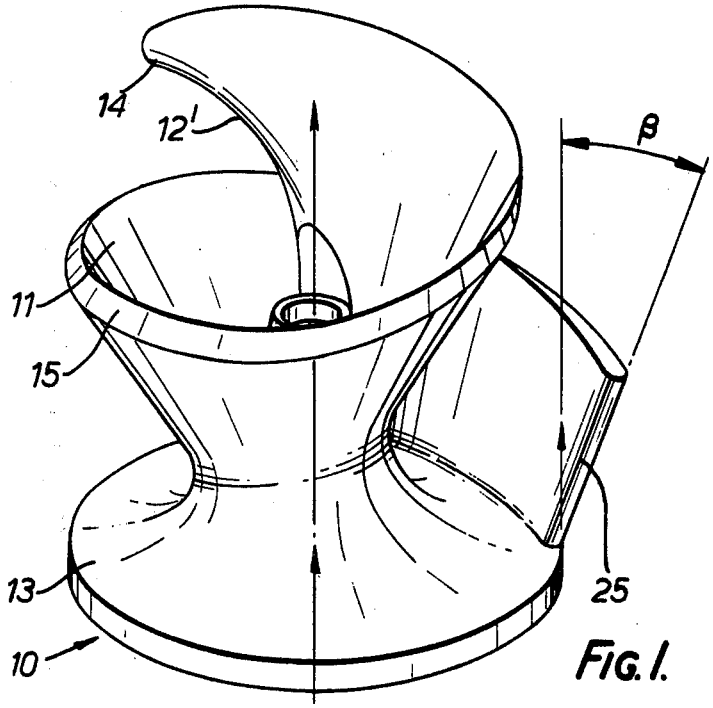
FIG. 1 shows an impeller embodying the invention in perspective.

The core 13 is hollow and is provided with means for attachment to a drive shaft and bearing assembly for rotation about its principal axis i.e. about the axis of symmetry of the core 13.

Above the top of the core 13 (i.e. on the upstream or inlet side thereof) the radially inner edge of the vane runs free up to the inlet tip 14 of the vane. The free run of the edge 12, referred to as the inlet edge, is shown as 12'. Where the inlet tip 14 of the inlet edge 12' meets the radially outer edge 15 of the vane 11, the inlet tip is spaced from the axis of the impeller.

Figure 3:
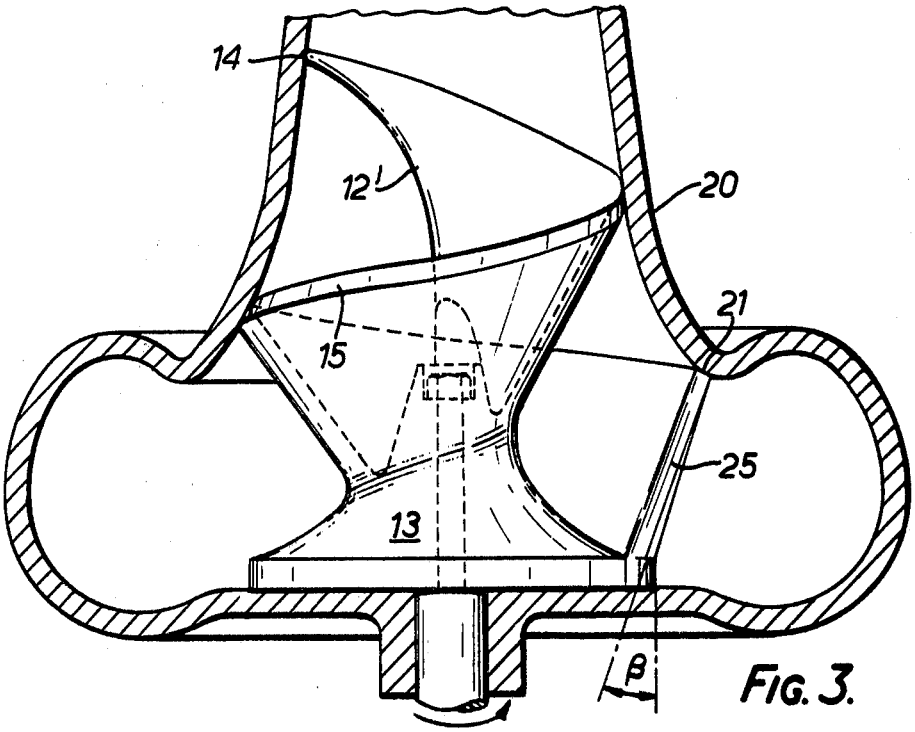
FIG. 3 is a partially sectional view through a pump incorporating the impeller of FIG. 1.
Figure 2:
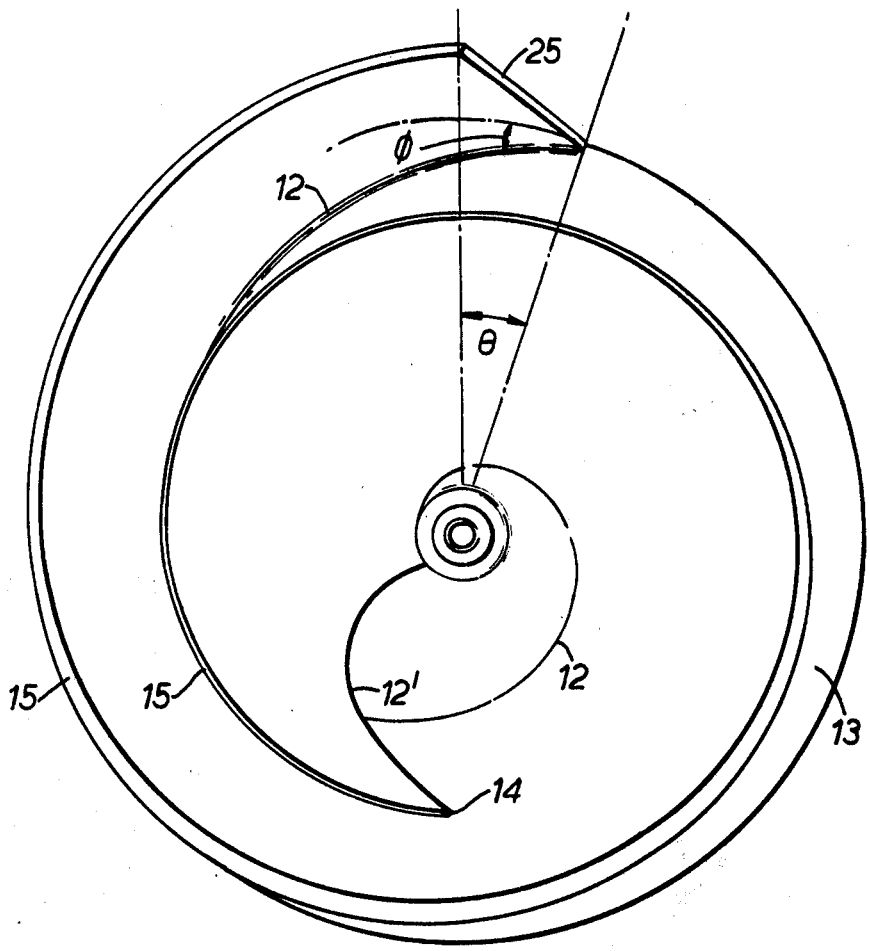
FIG. 2 is a plan view of the impeller of FIG. 1.

FIG. 3 shows a somewhat diagrammatic view of the impeller of FIG. 1 within a pump casing 20, from which it will be seen that the radially outer edge 15 is disposed to sweep the inner wall of the upper part of the casing 20 down to the point 21. The lower part of the casing 20 forms the volute and is provided with the outlet (not shown) from the pump.

The vane 11 undergoes considerable twist from the inlet to the outlet culminating in a radius angle $\approx$ at the outlet edge 25 of approximately 25°. It will be appreciated that the angle $\beta$ as shown on the perspective view of FIG. 1 is not an accurate representation but is merely intended to be illustrative.

The vane 11 of the impeller has a substantially linear outlet or trailing edge 25 which subtends an angle $\theta$, the subtended angle, at the axis of the impeller. This angle $\theta$ is in the region of 15° in the illustrated embodiment.

The outlet angle $\phi$ of the novel impeller is in the region of 10°.

The impeller 10 thus has a substantially axial flow inlet and by virtue of the increase in twist of the vane has a substantially centrifugal outlet configuration.

In order to modify the output characteristics of the impeller for a given rotational velocity the trailing edge 25 can be cut or machined thus altering the hydraulic characteristics of the pump. By appropriate combinations of angles $\beta$, $\theta$ and $\phi$ a considerable alteration in pumping characteristics can be brought about by a comparatively minor alteration of the trailing edge 25 without significantly effecting the inlet flow characteristics. Furthermore the resulting imbalance of the impeller can be corrected by simple adjustment of bob weights or the like (not shown) located within the core 13 of the impeller.

The machining e.g. to reduce the pump output, is done so as to remove material from the existing outlet edge producing a new outlet edge at a smaller effective radius. The required machining operations will be apparent to persons skilled in pump manufacture, but the following cutting instructions for a typical centre lathe turner are provided for guidance.

1. Load impeller to taper mandrel fixture and secure.
2. Set compound slide of machine to required angle (derived for $\beta$).
3. Remove material to bring vane to required diameter of intersection of outlet edge and radially outer edge of vane.
4. Clear carriage of machine and deburr machined surfaces.
5. Remove impeller from mandrel. The 'cut ' operation is now complete.
6. File vane to drawing requirements.
7. Re-balance impeller.

Figure 4:
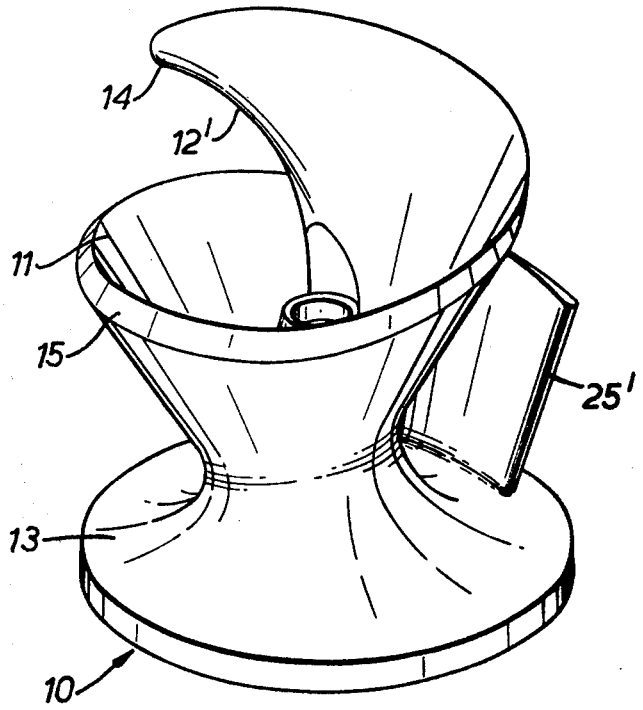
FIG. 4 shows the impeller of FIG. 1 after having been cut to modify its performance.

FIG. 4 shows the results of the above cutting process on the impeller of FIG. 1, the new outlet edge being shown as 25'.

Operational tests on pumps incorporating impellers according to the present invention show high efficiency for the type of pump, this efficiency being maintained over a broad band of flows. Also, a reasonable degree of cutting to modify their pumping characteristics has resulted in acceptable efficiency variations.

Obviously, numerous modifications and variations of the present invention are possible in light of the above teachings. It is therefore to be understood that within the scope of the appended claims, the invention may be practice otherwise than as specifically described herein.

I claim:

1. A rotodynamic impeller for a pump suitable for pumping liquids having entrained solid matter which comprises:

a flared core;

a single spiral vane encircling said flared core, the vane twisting by reduction of a radius angle thereof from a substantially axial inlet configuration to a substantially centrifugal outlet configuration, wherein the inlet configuration further comprises an inlet edge extending upstream and radially outwardly from the core at the axis thereof, the inlet edge being curved so as to increase the axial component thereof as it approaches the core such that, in operation in said pump, said solid matter impinging on the inlet edge will be swept inwardly along the edge and thence through the impeller to the outlet thereof, and wherein the outlet configuration is such that the radius angle of the vane at the outlet is less than 30°, the subtended angle thereof is less than 22½°, and the vane has a positive outlet angle which is in the range of 5° to 15°.

2. A rotodynamic impeller as claimed in claim 1 wherein the radius angle of the vane decreases by an angle in the range from 30° to 70° from the impeller inlet to the impeller outlet.

3. A rotodynamic impeller as claimed in claim 2 wherein the radius angle decreases at a regular rate.

4. A rotodynamic impeller as claimed in claims 1, 2 or 3, wherein the vane varies in cross-sectional shape from inlet to outlet.

5. A rotodynamic impeller as claimed in claim 4 wherein the vane curves upstream of its chord at its inlet and curves downstream of its chord at its outlet so as to form a smooth transition portion therebetween.

6. A rotodynamic impeller as claimed in claims 1, 2, or 3 further comprising means for providing static and dynamic balance about the impeller axis which comprises a variation of vane thickness in axial section along the vane.

7. A rotodynamic impeller as claimed in claims 1, 2, or 3 wherein the ratio of the radial distance of the inlet tip to the impeller axis to the axial length of the inlet edge is in the range of 0.5 to 0.75.

8. A rotodynamic impeller as claimed in claims 1, 2, or 3 wherein the axial distance from the inlet tip of the intersection of the radially outer vane edge and the outlet edge is equal to or greater than the axial length of the outlet edge.

9. A rotodynamic impeller as claimed in claim 1, 2, or 3, further comprising a pump casing within which said pump is disposed, and means for rotation of the impeller within the casing to pump said liquids and entrained solids therethrough.

10. A rotodynamic impeller as claimed in claim 1, wherein said inlet edge has an inlet tip and wherein the ratio of the radial displacement of the inlet tip from the axis of said impeller to the axial length of the inlet edge is in the range of 0.5 to 0.75.

11. A rotodynamic impeller as claimed in claim 1, wherein said core has an end portion and said inlet edge extends axially upstream of said end portion of said core and radially outwardly from said end portion.

* * * * *